United States Patent [19]

Müller et al.

[11] Patent Number: 4,680,946

[45] Date of Patent: Jul. 21, 1987

[54] FLAT-BED KNITTING MACHINE HAVING A SPOOL TABLE

[75] Inventors: Adam Müller; Ernst Goller, both of Reutlingen, Fed. Rep. of Germany

[73] Assignee: H. Stoll GmbH & Co., Fed. Rep. of Germany

[21] Appl. No.: 890,264

[22] Filed: Jul. 29, 1986

[30] Foreign Application Priority Data

Aug. 9, 1985 [DE] Fed. Rep. of Germany ..... 3528695

[51] Int. Cl.[4] ..... D04B 7/26

[52] U.S. Cl. ..... 66/64; 66/125 R; 66/167

[58] Field of Search ..... 66/125 R, 64, 167

[56] References Cited

U.S. PATENT DOCUMENTS 4,467,624 8/1984 Schimko ..... 66/125

*Primary Examiner*—Ronald Feldbaum

*Attorney, Agent, or Firm*—Jones, Tullar & Cooper

[57] ABSTRACT

A flat-bed knitting machine having a spool table disposed above the needle bed and carriage apparatus, preferably in a rear area of the machine, and on which there are a plurality of yarn spool holders is described. In order to make the spool table of such flat-bed knitting machines useable for other purposes, and also making the spool table easier to handle during assembly, the invention provides that the spool table comprises a plurality of interconnected extruded aluminum profile elements, which have integrated securing means on the surface for subsequently detachably securing yarn spool holders, and that the profile elements are provided on their lower portion with guide recesses, extending in the longitudinal extension of the spool table, for a protective cover and for an operating panel along with its control cables as well as for a trailing cable device.

23 Claims, 4 Drawing Figures

FLAT-BED KNITTING MACHINE HAVING A SPOOL TABLE

FIELD OF THE INVENTION

The present invention relates to a flat-bed knitting machine having a spool table disposed in a rear area of the machine above the needle bed and carriage apparatus. A multiplicity of yarn spool holders are disposed on the spool table.

BACKGROUND OF THE INVENTION

In a known flat-bed knittng machine of this type (see Brochure DNVHG-F published by the present assignee in March, 1984), the spool table is embodied as a board and is mounted directly on the machine frame. Below the spool table and also secured to the machine frame is a power cable device, which substantially comprises a plurality of rollers on which a group of randomly guided cables is suspended and which are supported so that they roll in a guide rail secured to the machine frame. A perforated cover plate, serving as a protective device, is also secured in the vicinity of the rear long edge of the spool table. If the flat knitting machine is provided with a transparent protective cover on its front side, that is, on the operator side, then the elements of this cover are also secured directly to the machine frame or to the support frame for the needle bed apparatus.

The flat-bed knitting machine known from German Pat. No. DE-C1 32 43 315 is similar in this respect; here the spool table is movable in the direction of the depth of the machine. In this flat-bed knitting machine, a flap that can be pivoted out of the way is provided as the protective cover, the upper free end of which, when the flap is in the covering position, rests on a cover strip attached to the spool table whenever the spool table is in its front position. This cover strip serving as a rest is inoperative whenever the spool table is in a rear position.

In every case, considerable engineering and assembly expense is necessitated, to secure the various required devices to the machine frame. The spool table embodied as a board is very heavy and is costly in terms of its assembly, or in terms of the attachment of the individual spool holders. The spool table provided with the spool holders is inconvenient both if it is to be shipped and in terms of handling it during assembly.

OBJECT AND SUMMARY OF THE INVENTION

It is accordingly an object of the present invention, in a flat-bed knitting machine of the above type, to make the spool table usable for additional purposes, and at the same time to make the spool table easier to handle during assembly.

To attain this object, the invention provides that the spool table of a flat-bed knitting machine of the above type comprises one or more interconnected extruded profile elements of nonferrous metal or aluminum with integrated securing means on their surface for subsequent detachable securing of yarn spool holders, and with guide recesses in their lower portion for a protective cover and/or for an operating panel and control cable or for a power cable device.

Thus the spool table can be used not only for detachably fixing spool holders, but at the same time for the disposition of the power cable and/or for displaceably receiving and holding the protective cover or an operating panel. This combined use of the spool table facilitates both the assembly of the flat-bed knitting machine and the manufacture of the otherwise separate elements in the form of a combined spool table. The spool table itself is easier to handle during assembly on the machine, because on the one hand it is lighter in weight than the usual board and on the other hand the desired number of yarn spool holders can simply be attached subsequently, that is, after the spool table has been installed on the machine frame, in a desired manner.

According to an exemplary embodiment of the present invention, the spool table is available for another purpose because a profile element has a guide recess for at least one removable back wall in the area of the rear long edge of the spool table and parallel thereto. This again facilitates assembly and also suitably assures quick access to the rear area of the flat-bed knitting machine for preparing, servicing or repair work.

The individual guide recesses are suitably embodied by hollow spaces inside the profile elements, and an additional profile element is suitably provided for the protective cover, facing the underside of the spool table and joined to the associated profile element. This makes it possible for the guide recess for the protective cover to be replaced, if it can be dispensed with, by something else that has only the guide for the control cable of the operating panel.

The additional profile element is also suitably provided with preferably a plurality of recesses for the stationary part of a proximity switch device, the movable switch part of which is connected to the associated hood of the protective cover. Thus the machine is provided with a safety monitor in a space-saving manner.

The spool table, or its profile elements, are provided with longitudinally extending parallel hollow reinforcing profile sections, which lend the spool table the required inherent stability. Suitably, securing profile sections are provided on the lower ends of these hollow reinforcing profile sections, so that the spool table can be secured to the machine frame in a simple manner.

If the spool table is composed of a plurality of individual profile elements, then profile elements provided with the guide recesses and the hollow reinforcing profile sections as well as with the securing means for the yarn spool holders are provided, as well as intermediate profile sections which have a substantially plane surface in the middle and the long edge of which are interlockingly cold welded to the long edges of the above-mentioned profile elements. This makes it possible for the spool table, which because it is manufactured by extrusion can in any case have a variable length, to be varied in its width as well, so that intermediate profile elements of differing width can be used.

Further details and features of the invention will become apparent from the ensuing description of an exemplary embodiment of the invention, taken in conjunction with the drawings.

BRIEF DESCRIPTION OF THE INVENTION

Figure 1:
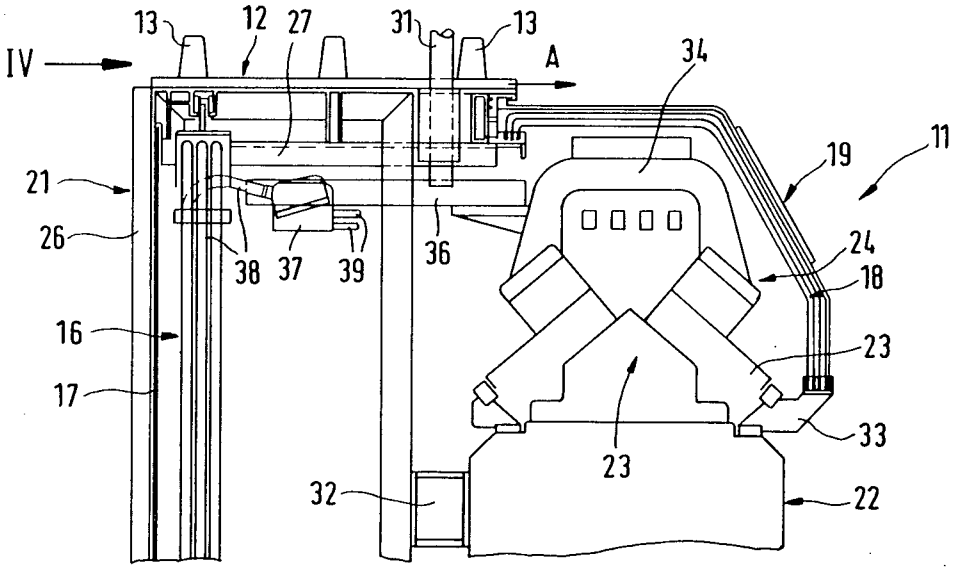
FIG. 1 is a schematic, fragmentary side view of a flat-bed knitting machine according to an exemplary embodiment of the present invention.
Figure 2:
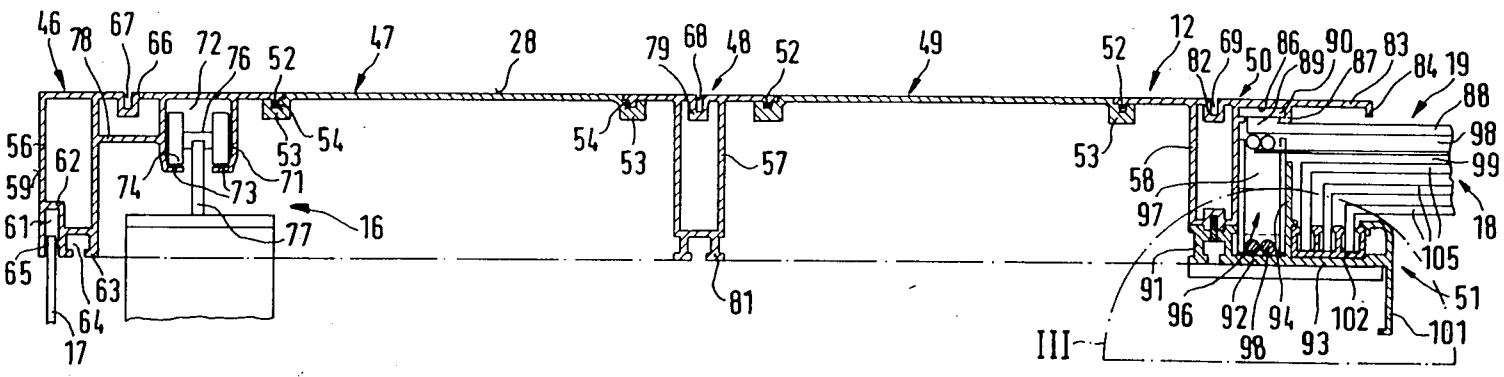
FIG. 2 is a cross section, taken parallel to the side view of FIG. 1, through a spool table of the flat-bed knitting machine of the invention, on a larger scale.
Figure 3:
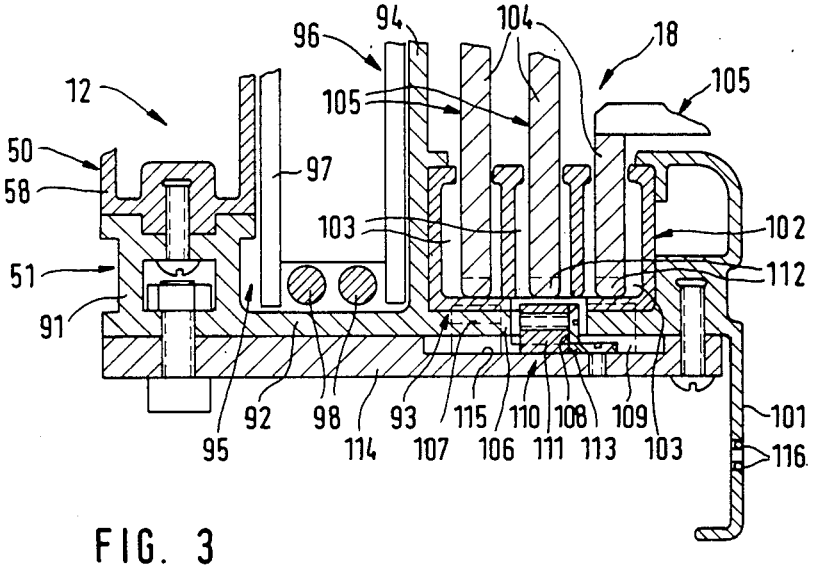
Figure 4:
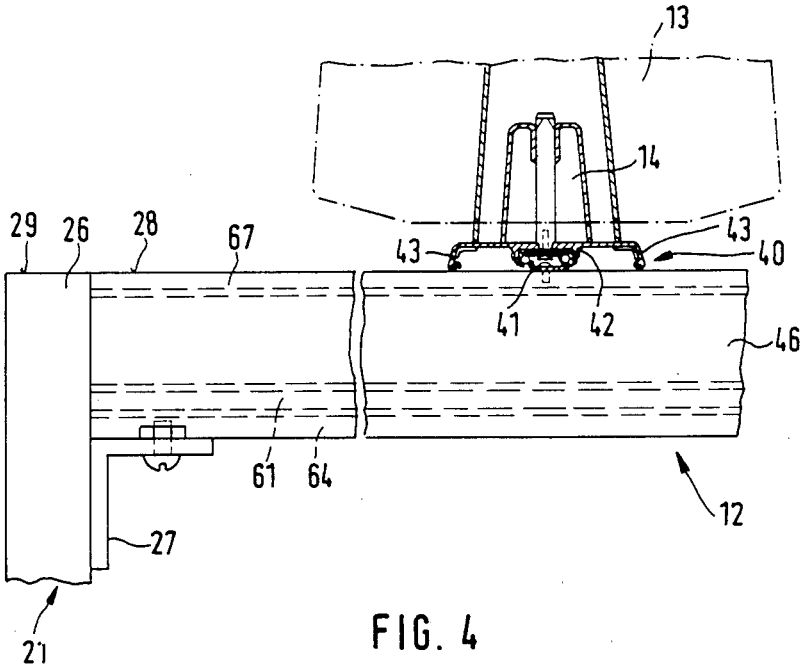

FIG. 3, on a larger scale, shows a detail of the area contained in the semicircle III of FIG. 2; and FIG. 4, on a larger scale, is a view along the arrow IV of FIG. 1, but substantially of the spool table only.

DESCRIPTION OF THE PREFERRED EMBODIMENT

The flat-bed knitting machine 11 shown in the drawing and according to a preferred exemplary embodiment of the present invention is provided according to the invention with a spool table 12, embodied such that it is suitable not only for holding and supporting a multiplicity of yarn spool holders 14 or yarn spools 13, but also for holding and guiding a trailing power cable device 16, a removable back wall 17, a front protective cover 18 and an operating panel 19, located in front of this cover, for operator control of the flat-bed knitting machine 11.

As shown in FIG. 1, the flat-bed knitting machine 11 has a rear machine frame 21, on which the spool table 12, among other elements, is secured and held stationary, as well as a front machine frame 22, which has a needle bed apparatus 23 with a carriage apparatus 24. The rear machine frame 21 substantially comprises two upright rectangular frames 26 on the ends and at least one projecting intermediate frame, which is not shown here. On their insides facing one another, the side frames 26 are firmly connected to an angle bar 27, which protrudes beyond the depth of the frame 26 toward the carriage apparatus 24, and the spool table 12 rests on and is secured to the two angle bars 27. The arrangement of the spool table 12 on the angle rails 27 and their securing to the frames 26 is such that the surface 28 of the spool table 12 is approximately flush with the top 29 of the frame 26.

Also secured on the side frames 26 are supports 31, protruding vertically upward, of a yarn supply apparatus not otherwise shown. The two side frames 26 are interconnected by means of an upper crossbar 32 and a lower crossbar that is not shown, and are firmly connected to the front machine frame 22. In the vicinity of the front needle bed 23v, a longitudinally extending profile holder strip 33 is provided on the front machine frame 22, forming the lower means of support and guidance for the protective cover 18 and the operating panel 19. A horizontal support plate 36 oriented toward the rear machine frame 21 is secured to a connecting bridge 34 of the carriage apparatus 24, and couplings 37 which connect the cables 38 of the power cable device 16 with the cables 39 that lead to the carriage apparatus 34 are retained on the support plate 36.

The embodiment of the spool table 12 is shown particularly clearly in FIG. 2. The spool table 12 is composed of a plurality of elongated extruded profile elements 46–50 of aluminum, which are firmly connected to one another by cold welding, and of an additional, also elongated extruded profile element 51 of aluminum that is screwed to the elements 46–50. On their facing long edges, the profile elements 46–50 have means for effecting connection flush with the surface, in the form of molded-on ribs 52 protruding vertically from the underside and in the form of longitudinally extending grooves 54 receiving these ribs 52 and each provided on one molded-on portion 53. The middle profile elements 47 and 49, which are approximately equal in width, have the molded-on portions 53 but are otherwise flat on both their top and bottom surfaces. The elements 46–51 may also be made of some other nonferrous metal, or of a suitable plastic.

The left-hand profile element 46 in FIG. 2 has a hollow reinforcing profile 56 of box-like form protruding from its underside and extending over its entire length; adjacent to the outside 59, a guide recess for the rear wall 16 in the form of a hollow profile 62 having a hollow space 61 open at the bottom and adjacent to it a hollow securing profile 63 having a hollow space 64 that is enlarged facing an access slit are integrated with the hollow reinforcing profile 56. On its inside faces, the hollow profile 62 is provided with lip-like molded-on portions 65, which form a restriction that fixes the rear wall 16 in place. A longitudinally extending securing groove 67 for the yarn spool holders 14 is provided in the top of a U-shaped molded-on rib 66 adjacent to the hollow reinforcing section 56. Between this securing groove 67 and the connecting rib 52, a hollow profile 71 is molded on, protruding from the underside; on its end open toward the bottom this profile 71 is restricted by two inwardly bent guide rails 73. In the hollow space 72 forming a guide recess, the power cable device 16 is received in a longitudinally guided manner; this cable device 16 has a trolley provided with at least a pair of rollers 74, and a bunch of cables 38 of the power cable device 16 are secured suspended from the trolley holder 77, which is suspended vertically to the axis of the rollers. The hollow profile 71 is connected to the hollow reinforcing profile 56 via a crossbar 78.

The middle profile element 48 also has a hollow reinforcing profile 57, into which a U-shaped longitudinally extending molded-on rib 76 having a longitudinally extending securing groove 68 for the yarn spool holder 14 is integrated, and a hollow securing profile 81, having a restricted access slit, is molded onto the lower end of the hollow reinforcing profile 57.

The profile element 50 shown on the right in FIG. 2 has a hollow reinforcing profile 58 protruding vertically from its underside, and a U-shaped molded-on rib 82 having a longitudinally extending securing groove 69 is integrated into the top of this profile 58. On the side of the hollow reinforcing profile 58 remote from the connecting rib 52, the profile element 50 has a longitudinally extending lateral projection 83, the front long edge 84 of which is bent downward and which has on its underside, immediately adjacent to the hollow reinforcing profile 48, a hollow receiving space 86 in the manner of an undercut groove formed by a corresponding double-L-shaped hollow profile 87. This hollow space 86 serves to receive a plate 88 of the operating panel 19 in a guided manner. At the free end of its horizontal portion, this plate 88 has a vertically protruding molded-on portion 89, with a sliding block 90 engaging the undercut groove 86.

The hollow reinforcing profile 58, which is shorter than the other hollow reinforcing profiles 56, 57 by approximately the height of their securing profiles 63 and 81, respectively, is screwed to a hollow securing profile 91, which is a molded-on part of the additional profile element 51. This additional profile element 51 is connected via a longitudinally extending intermediate rib 91 with a groove-like hollow profile 83, the side wall 94 of which facing the hollow securing profile 91 is extended toward the projection 83 and together with the opposed wall area of the hollow reinforcing profile 58 and of the hollow securing profile 95 forms a hollow space 95, which serves as a guide recess for a spring-loaded cable holder device 96. This cable holder device 96 is received in the hollow space 95 such that it can move slidingly in the longitudinal direction of the spool table 12 and it has a deflection roller 97, secured to a carriage, for control cables 98, for example two in number, which are guided into the hollow space 95 between a plate 88 and a bottom 99 of the operating panel 19 from the input keyboard, not shown, of this panel.

The outside wall 101 of the groove-like hollow profile 93 is extended vertically downward past the underside. The groove-like hollow profile 93 has a longitudinally extending, finger-like insert 102, which has three parallel longitudinally extending guide grooves 102, in which the vertically downwardly extending ends 104 of a horizontal portion, or of three pairs of transparent hoods 105, of the protective cover 18 are received in a longitudinally movable and slidable manner. The pairs of hoods 15 are disposed parallel to and spaced apart from one another, so that they can be pushed into any position.

As shown in FIG. 3, the additional profile element 51 is provided in the bottom 106 of the hollow profile 93 and of the insert 102 with a plurality of pairs of recesses 107, 108 and 109 for the stationary switch part 111 of a contactless or proximity switch device 110, the movable switch part 112 of whic is in the form of a metal plate introduced into the free end 104 of each hood 105 and secured there. The stationary switch part 111 is secured to one leg of an angle element 113, the other leg of which, at right angles to it, is secured to a retainer plate 114, in the recess 115 thereof. The retainer plate 114 is screwed to the underside of the additional profile element 51 or to its hollow securing profile 91 and to the end of the hollow profile 93.

The relative position of the switch parts 111 and 112 for each of the transparent hoods 105 of the protective cover 18 is such that when one of the hooks 105 is opened a switching event is triggered, which either shifts the carriage apparatus 24 down to a crawl or stops it completely. It will be understood that the length of the switch parts is much less than that of the hoods. Two light-emitting diodes 116, for example, are introduced into the wall or screen 101 of the additional profile element 51 such that they are visible from the outside; these indicate whether the hood or hoods are open or closed.

As shown in FIG. 4, the spool table 12 is connected to the angle bars 27 on the ends and possible partly at the middle via the securing profiles 63, 81 and 91, with the retainer plate 114 located between them. A stationary rail 41 is secured in each of the securing grooves 67–69 of the individual profile elements 46, 48 and 50, preferably extending obliquely to them but extending from back to front and belonging to a respective telescoping pull-out device 40. On this stationary rail 41 fixed in the securing grooves, the movable rail 42 is movable back and forth in the direction of the arrow A in FIG. 1 via roller bearings. On this movable rail 42, which is slidingly supported, via its two longitudinal extending and downwardly extended long edges 43, on the surface 28 of the spool table 12, yarn holders 14, for instance three in number, are disposed beside one another, or offset one after the other as viewed from the standpoint of the machine operator, and the yarn spools 13 are mounted on these yarn spool holders 14.

It will be understood that the individual profile elements 46–51 are of equal length, and that the equally wide middle profile elements 47 and 49 may be replaced by elements not having equal width, depending on the desired width or depth of the spool table 12 with its continuous flat surface 28. It will also be understood that the back wall 17 may comprise a plurality of individual wall parts, which may be inserted from below into the hollow receiving space 61, arranged beside one another. A hollow receiving space, not shown, is also provided toward the bottom, into which the rear wall, after being introduced into the upper hollow space 61, can be set down. Optionally, two or more parallel hollow spaces 61 may also be provided for receiving door elements that can slide over one another. A trolley or trolleys, preferably a plurality of trolleys 76, are provided for holding the upper portions of the randomly arranged, downward-handing cables are held and guided in a longitudinally movable manner in the hollow space 72 for the power cable device 16.

What is claimed is:

1. A flat-bed knitting machine, comprising:
a needle bed apparatus;
a carriage apparatus;
an operating panel including control cables therefore;
a protective cover;
a trailing cable device; and
a spool table disposed in the rear area of the machine above the needle bed apparatus and the carriage apparatus, said spool table having a plurality of yarn spool holders disposed thereon, wherein;
the spool table comprises one or more interconnected extruded profile elements each having a top and bottom region with the top region having integrated securing means defined therein for detachably securing the yarn spool holders, and with the bottom region having guide recesses extending along the longitudinal extent of the spool table for receiving at least one of the protective cover, the operating panel and the trailing cable device.

2. The flat-bed knitting machine as defined in claim 1, wherein the profile elements are extruded aluminum.

3. The flat-bed knitting machine as defined in claim 1, wherein the profile elements are extruded nonferrous metal elements.

4. The flat-bed knitting machine as defined in claim 1, further comprising:
at least one removable back wall and wherein one of said guide recesses in the vicinity of the rear long edge of the spool table and parallel thereto serves as the guide recess for said at least one removable back wall.

5. The flat-bed knitting machine as defined in claim 4, wherein said guide recess for said back wall is embodied by a groove-like hollow space, open at the bottom, which at one area of its height is provided with at least one inwardly protruding lip-like molded on element.

6. The flat-bed knitting machine as defined in claim 1, wherein the guide recess for the trailing cable device is embodied by a hollow space, the open lower end of which is narrowed by means of two parallel, inwardly pointing, rail-like molded-on elements for a pair of rollers.

7. The flat-bed knitting machine as defined in claim 6, wherein the protective cover comprises a plurality of parallel transparent hoods or pairs of hoods, and a corresponding number of grooves embodied by a profile strip having a finger-shaped cross section.

8. The flat-bed knitting machine as defined in claim 7, further comprising:
an additional profile element located opposite the underside of a profile element of the spool table on the front long side of the spool table and joined thereto, wherein the profile strip with the finger-shaped cross section is retained in the additional profile element.

9. The flat-bed knitting machine as defined in claim 1, further comprising:

a hollow profile member embodied as a molded-on extension of one of said profile elements, wherein the operating panel further includes a displaceable plate, and wherein the hollow profile member defines a hollow space formed in the manner of an undercut groove that is open at the bottom which serves as a guide recess for the displaceable plate.

10. The flat-bed knitting machine as defined in claim 9, further comprising:

a sliding block connected to the displaceable plate, wherein the sliding block engages the guide recess.

11. The flat-bed knitting machine as defined in claim 1, further comprising:

a spring-loaded device; and a holder device for the spring-loaded device, wherein said spring-loaded device serving to motion guidely receive the control cables of the trailing cable device in any position of the operating panel along the machine.

12. The flat-bed knitting machine as defined in claim 11, further comprising:

an additional profile element located opposite the underside of a profile element of the spool table on the front long side of the spool table and joined thereto, wherein said additional profile element serves as said holder device.

13. The flat-bed knitting machine as defined in claim 1, wherein the extruded profile elements include a plurality of profile elements arranged parallel to each other and embodied as hollow reinforcing profile elements.

14. The flat-bed knitting machine as defined in claim 13, wherein the extruded profile elements further include a plurality of profile elements each molded to a respective one of the reinforcing profile elements and serving as undercut hollow securing profile elements.

15. The flat-bed knitting machine as defined in claim 14, further comprising:

at least one removable back wall, wherein one of said guide recesses in the vicinity of the rear long edge of the spool table and parallel thereto serves as the guide recess for said at least one removable back wall, and wherein said guide recess is formed in one of said reinforcing profile elements.

16. The flat-bed knitting machine as defined in claim 14, further comprising:

an additional profile element, wherein the protective cover comprises a plurality of parallel transparent hoods or pairs of hoods, and a corresponding number of grooves embodied by a profile strip having a finger-shaped cross section, said profile strip with the finger-shaped cross section being retained in the additional profile element, and wherein said additional profile element is molded onto one of the securing profile elements.

17. The flat-bed knitting machine as defined in claim 13, wherein the extruded profile elements further include a plurality of profile elements each secured to a respective one of the reinforcing profile elements and serving as undercut hollow securing profile elements.

18. The flat-bed knitting machine as defined in claim 17, further comprising:

at least one removable back wall, wherein one of said guide recesses in the vicinity of the rear long edge of the spool table and parallel thereto serves as the guide recess for said at least one removable back wall, and wherein said guide recess is formed in one of said reinforcing profile elements.

19. The flat-bed knitting machine as defined in claim 17, further comprising:

an additional profile element, wherein the protective cover comprises a plurality of parallel transparent hoods or pairs of hoods, and a corresponding number of grooves embodied by a profile strip having a finger-shaped cross section, said profile strip with the finger-shaped cross section being retained in the additional profile element, and wherein said additional profile element is molded onto one of the securing profile elements.

20. The flat-bed knitting machine as defined in claim 1, further comprising:

intervening, substantially flat profile elements, wherein a plurality of extruded profile elements are provide interconnected by an intervening profile element by means of interconnecting cold-welded longitudinal edges.

21. The flat-bed knitting machine as defined in claim 1, wherein the securing means for the yarn holders are embodied as parallel, longitudinally extending grooves.

22. The flat-bed knitting machine as defined in claim 1, further comprising:

an additional profile element; and a proximity switch device having a stationary part wherein the protective cover comprises a plurality of parallel transparent hoods or pairs of hoods, and a corresponding number of grooves embodied by a profile strip having a finger-shaped cross section wherein the profile strip with the finger-shaped cross section is retained in the additional profile element, and wherein said additional profile element has one or more recesses for the stationary part of the proximity switch device.

23. The flat-bed knitting machine as defined in claim 1, wherein the spool table has a guide recess for the protective cover said guide recess being embodied by at least one groove that is open at the top.

* * * * *